US006536971B1

(12) United States Patent
Schouten

(10) Patent No.: US 6,536,971 B1
(45) Date of Patent: Mar. 25, 2003

(54) CONTOURED WASH MIT ASSEMBLY

(75) Inventor: Pieter Schouten, Oakland, CA (US)

(73) Assignee: Carrand Companies, Inc., Compton, CA (US)

( * ) Notice: Subject to any disclaimer, the term of this patent is extended or adjusted under 35 U.S.C. 154(b) by 0 days.

(21) Appl. No.: 09/945,220

(22) Filed: Aug. 31, 2001

(51) Int. Cl.[7] ..... A46B 5/04

(52) U.S. Cl. ..... 401/8; 401/289; 401/266; 401/261; 401/11

(58) Field of Search ..... 401/7, 6, 8, 9, 401/11, 261, 266, 289

(56) References Cited

U.S. PATENT DOCUMENTS 2,538,850 A * 1/1951 Simms ..... 401/7
4,032,239 A * 6/1977 Maupin ..... 401/289

* cited by examiner

*Primary Examiner*—David J. Walczak
(74) *Attorney, Agent, or Firm*—George R. McGuire; Hancock & Estabrook, LLP

(57) ABSTRACT

A wash mit assembly comprising a rigid or semi-rigid body, a hose coupling interconnected to the body, and a cloth removably connected to the body. The body includes an exterior surface that is generally concave in shape, a hose receiving recess formed in the exterior surface along its longitudinal axis, a strap extending transversely across the recess, and openings formed through opposing sides of the recess for receiving nozzles of the hose coupling therein. The cloth includes a drawstring stitched about its periphery and is removably connected to the body in complete covering relation to the body's inwardly facing surface. To connect the cloth to the body, the body is positioned on the cloth, and the drawstring of the cloth is pulled taut so that the edge of the body is encompassed within the edge of the cloth.

11 Claims, 7 Drawing Sheets

CONTOURED WASH MIT ASSEMBLY

BACKGROUND OF THE INVENTION

The present invention relates generally to cloths used for washing, dusting, polishing, or waxing items, such as cars, and more particularly to wash cloth assemblies that contour both a person's hand and the surface of the item being cleaned.

A cloth or buffer is an essential tool for washing a car by hand. Typically, the cloth is composed of a material that has good water and soap absorption properties, and is soft enough so as not to scratch the paint surface of the car, such as sponge or sheep's wool. The person washing the car will conventionally use a hose to pre-soak the car, and will then fill a bucket with a car wash soap concentrate and water. The user will then soak the cloth in the bucket and proceed to wash the car. Once the car is washed, the user will use the hose to rinse the soap off of the car, and will then dry and wax the car.

While the above procedure works well, the bucket of soapy water becomes dirty after the cloth has been used to scrub the car and then placed back into the bucket. The dirt particles then get caught in the cloth, thereby causing them to be scrubbed into the car once again. In addition, the dirt particles may scratch the paint on the car's surface.

Use of a bucket of soapy water to wash a car also requires that the user dip his/her hands into the water each time the cloth is soaked. Thus, the user's hands become wet which in cold weather climates can be uncomfortable, and can also cause the user to drop the cloth, thereby causing it to pick up dirt from the ground.

When cleaning items that may have uneven surfaces, portions of the surface are sometimes missed due to the inability of the cloth (or other cleaning implement) to contour around the uneven surface. Thus, some portions of uneven surfaces may not get as clean as the remaining portions of the surface.

It is therefore a principal object and advantage of the present invention to provide a wash mitt assembly that straps to and contours a person's hand, thereby making it easier to handle.

It is a further object and advantage of the present invention to provide a wash mitt assembly that can contour around uneven surfaces.

It is another object and advantage of the present invention to provide a wash mitt assembly that may be directly interconnected to a water supply, such as a hose, or a cleaning implement, such as a pole.

It is yet an additional object and advantage of the present invention to provide a wash mitt assembly that is durable and easily manufactured.

Other objects and advantages of the present invention will in part be obvious, and in part appear hereinafter.

SUMMARY OF THE INVENTION

In accordance with the foregoing objects and advantages, the present invention provides a wash mitt assembly comprising a rigid or semi-rigid body and a cloth connected to the body. The body includes an exterior surface that is generally concave in shape, a hose receiving recess formed in the exterior surface along its longitudinal axis, a strap extending transversely across the recess, and openings formed through opposing sides of the recess for receiving nozzles of a hose coupling therein. The cloth includes a drawstring stitched about its periphery and is removably connected to the body in complete covering relation to the body's inwardly facing surface (although a cloth that is permanently affixed to the body could also be used, the removable connection is preferred due to the versatility it offers the tool). To connect the cloth to the body, the body is positioned on the cloth, and the drawstring of the cloth is pulled taut so that the edge of the body is encompassed within the edge of the cloth.

A hose receiving coupling including an internally threaded portion to which a hose (or other cleaning implement, such as a pole) may be connected and a pair of nozzles extending outwardly from opposing sides of the coupling is connected to the body with the nozzles extending through the openings formed in opposing sides of the hose receiving recess. A hose (or other cleaning implement, such as a pole) may be connected to the coupling and positioned within the recess formed in the exterior surface of the body. Soap may be dispensed on the cloth, and when the hose is turned on water will flow through the nozzles of the coupling and continuously soak the cloth. A user may place his/her hand through the strap and wash the car by in scrubbing it with the assembly. It should be pointed out that the present invention could certainly be used to clean items other than cars, but cars are referred to herein for purposes of showing an exemplary use of the invention.

BRIEF DESCRIPTION OF THE DRAWINGS

The present invention will be more fully understood and appreciated by reading the following Detailed Description in conjunction with the accompanying drawings, wherein.

DETAILED DESCRIPTION

Figure 13:
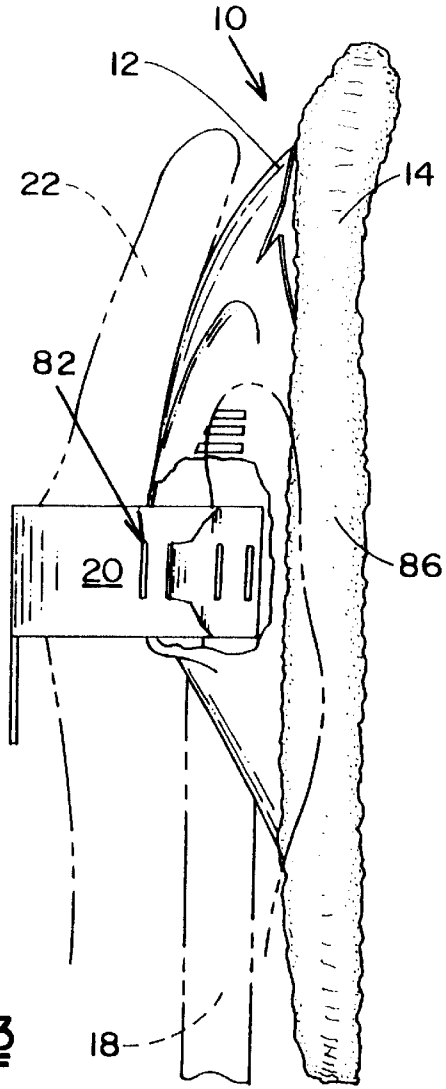
FIG. 13 is a side elevation view of the wash mitt assembly.
Figure 12:
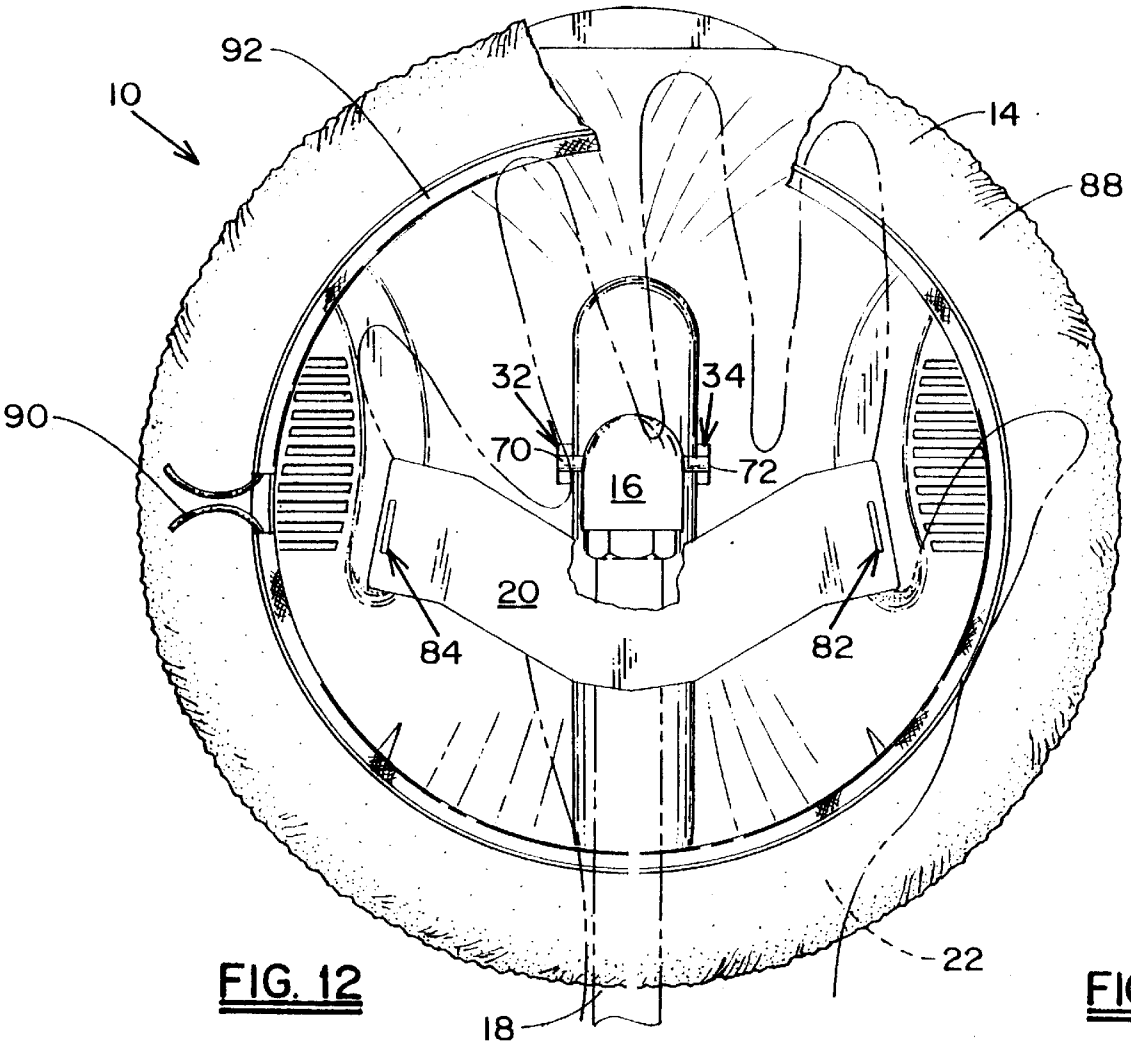
FIG. 12 is a top plan view of the wash mitt assembly.
Figure 14:
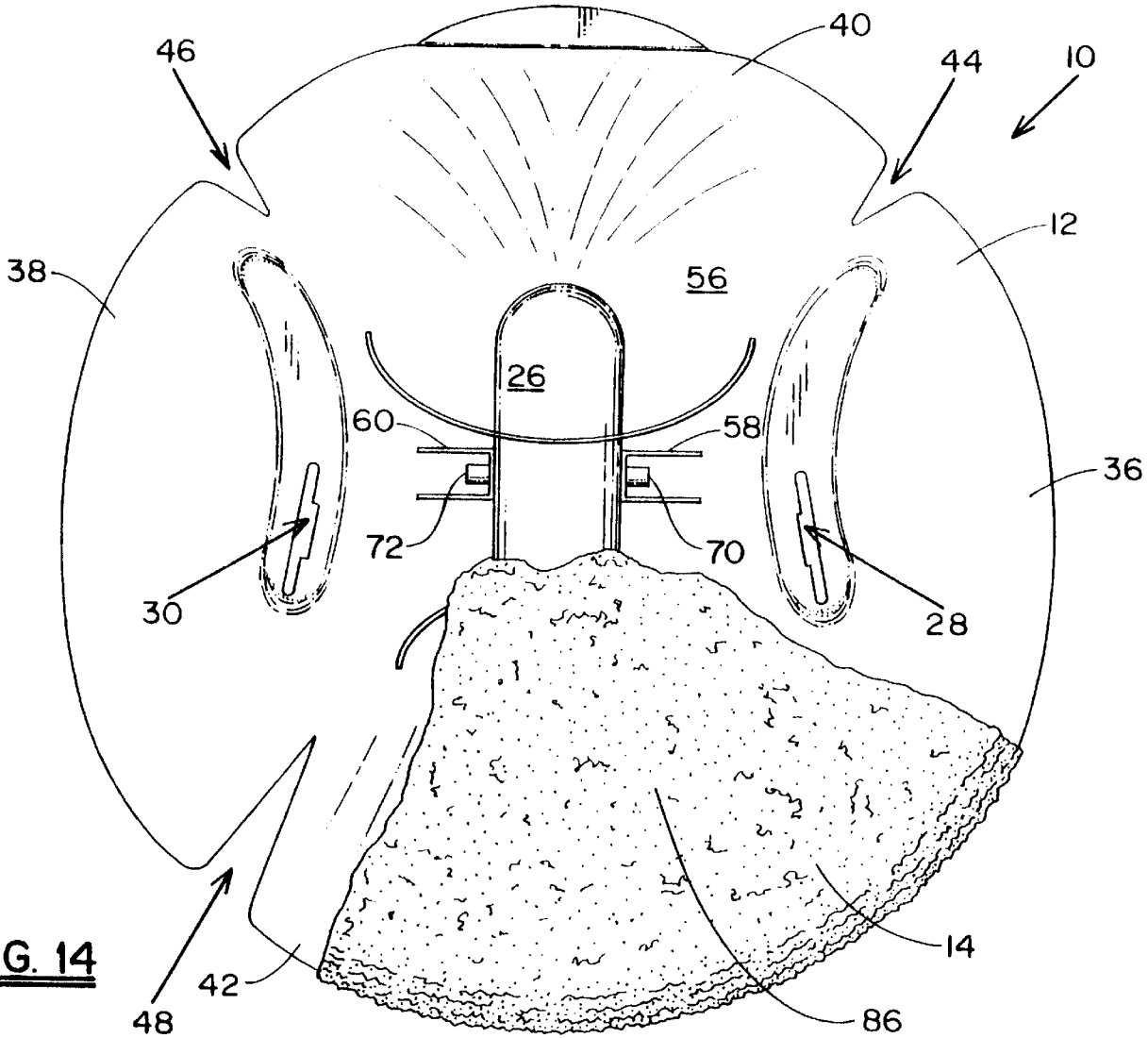
FIG. 14 is a bottom plan view of the wash mitt assembly with portions cut away therefrom.

Referring now to the drawings, wherein like reference numerals refer to like parts throughout, there is seen in FIGS. 12–14 a wash mitt assembly, designated generally by reference numeral 10, generally comprising a body 12, a cloth 14 connected to body 12, a hose coupling 16 for interconnecting a hose 18 to assembly 10, and a strap 20 through which a user's hand 22 may be positioned for holding and using assembly 10. Assembly 10 is useful for, among other things, washing, dusting, polishing, waxing, or drying cars or other items. In addition, although coupling 16 is described herein to receive a hose 18, it could also be used to receive any cleaning implement, such as a pole.

Figure 2:
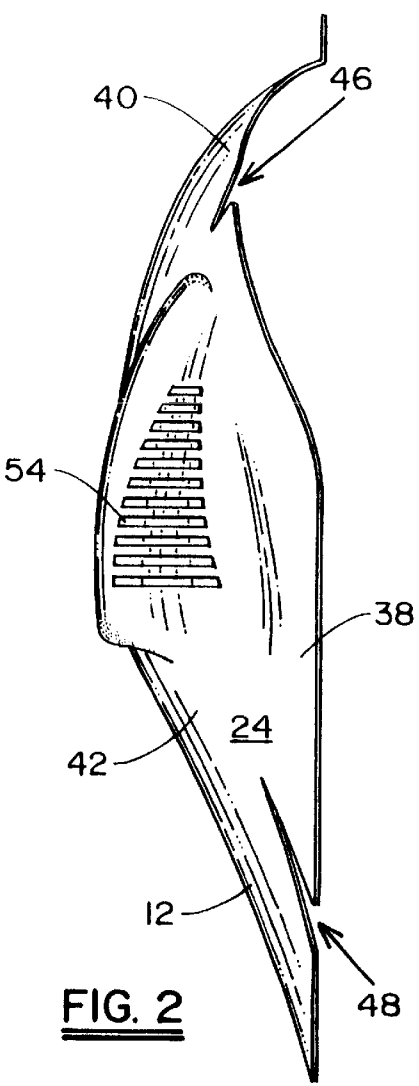
FIG. 2 is a side elevation view of the body.
Figure 1:
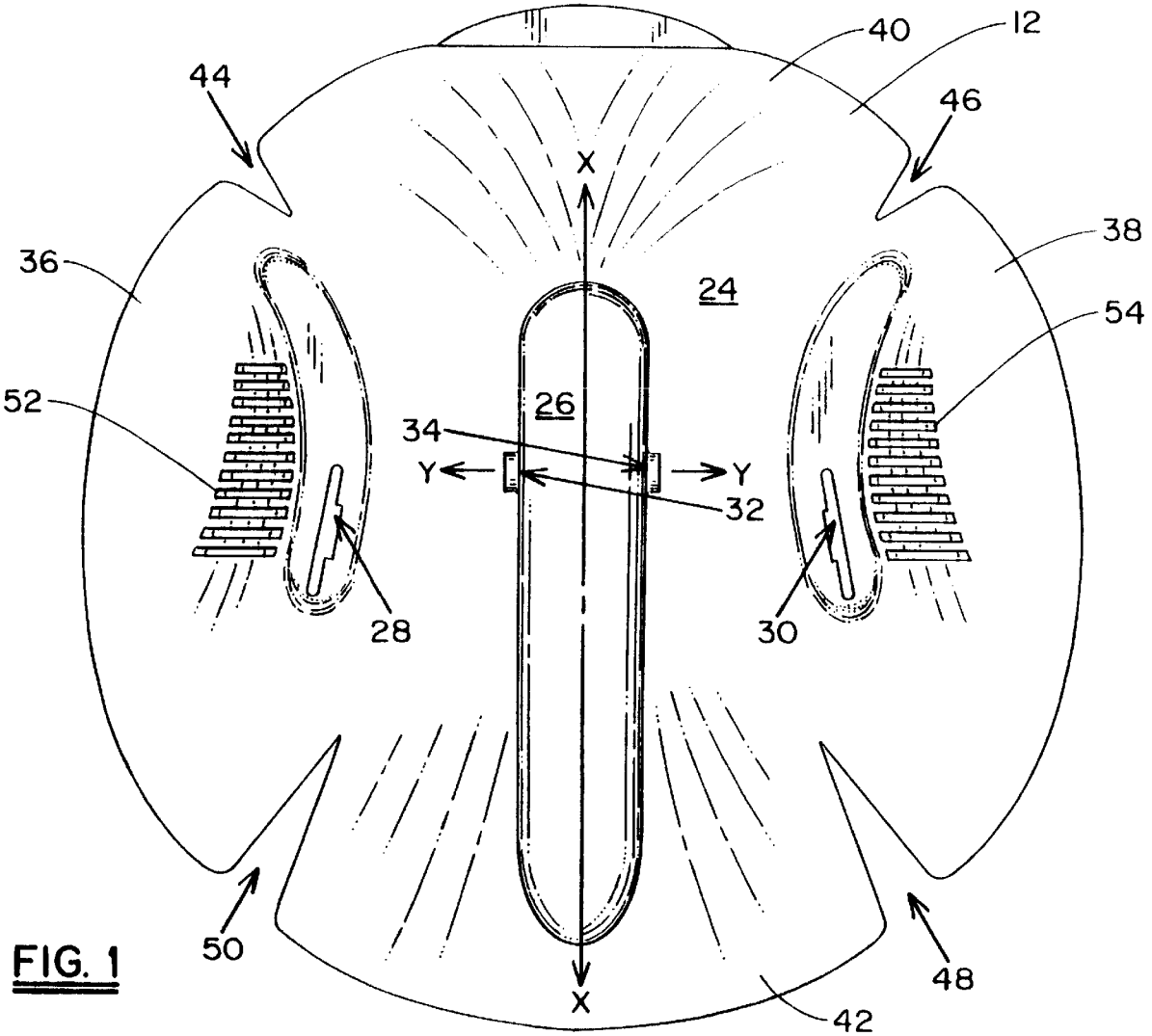
FIG. 1 is a top plan view of the body of the present invention.

Referring to FIGS. 1–2, body 12 is seen to include an outwardly facing surface 24 that is generally concave in shape. Surface 24 includes a hose receiving recess 26 formed therein which extends along the longitudinal axis X—X of body 12, a pair of strap receiving openings 28, 30 formed through body 12 on opposing sides of recess 26, and a pair of nozzle openings 32, 34 formed through opposing sides of recess 26 and along an axis Y—Y that is transverse to axis X—X.

Body 12 is preferably composed of a rigid or semi-rigid material, such as plastic, and is generally divided into four sections; two sides 36, 38, and front 40 and rear 42 sections. Notches 44, 46, 48, and 50 formed in the edges of body 12 roughly define the divisions between the sections, and permit assembly 10 to flex and adapt to and contour a person's hand, and permit cloth 14 to contour an uneven surface over which it may be wiped. Surface 24 slopes downwardly from about its geometric center (i.e., the intersection of axis X—X and axis Y—Y) towards the edges of sections 36, 38, 40, and 42, thereby defining its concave shape. Finger (thumb) grips 52, 54 are formed in surface 24 of side sections 36, 38, respectively.

Figure 3:
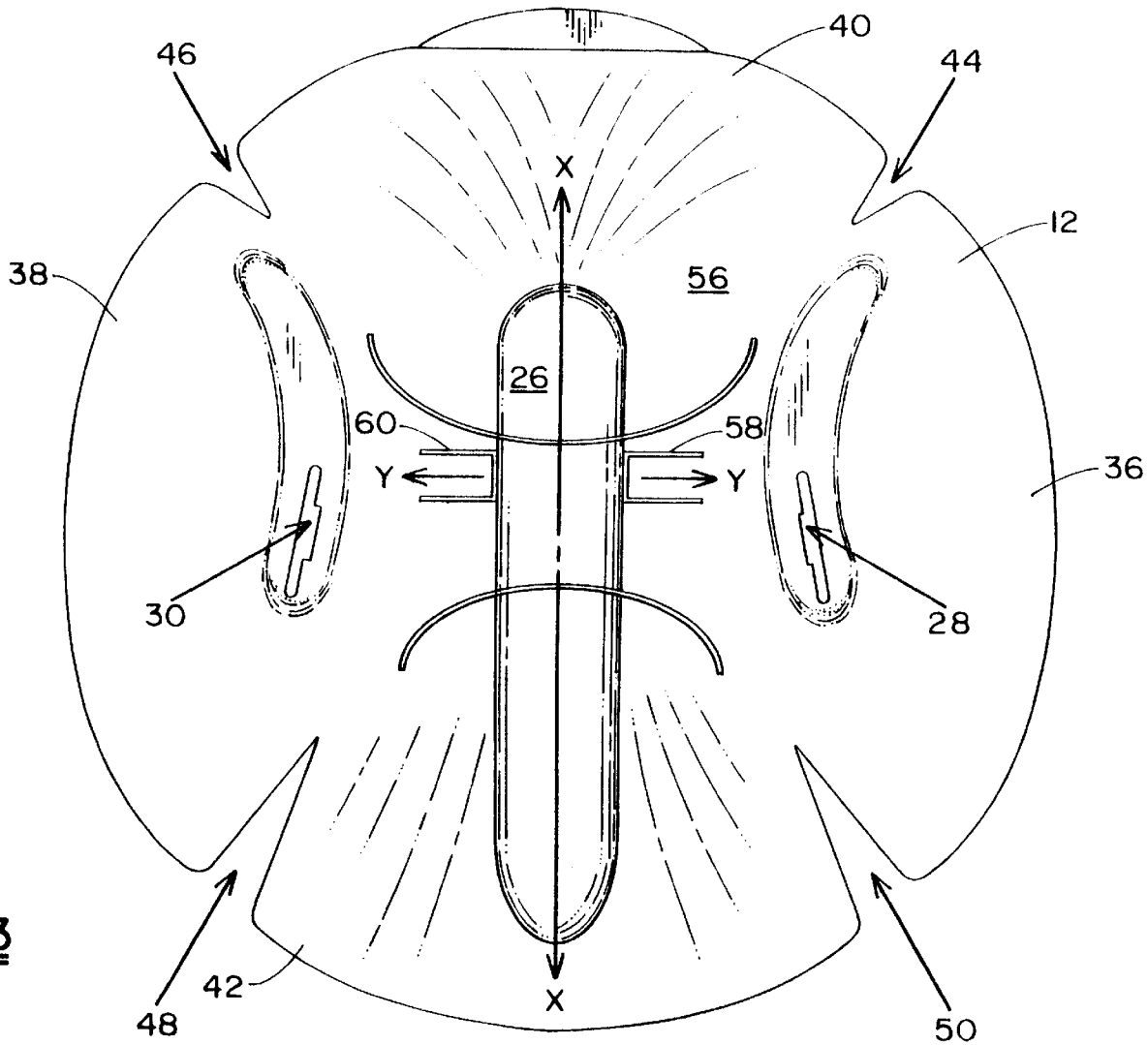
FIG. 3 is a bottom plan view of the body.
Figure 4:
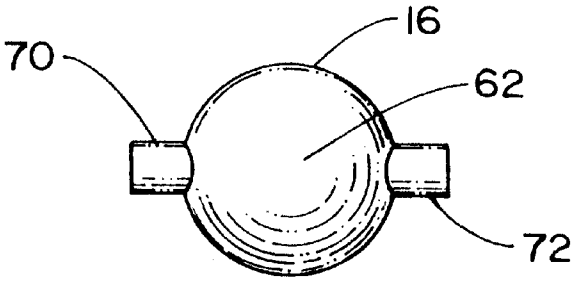
FIG. 4 is a top plan view of the hose coupling of the present invention.
Figure 6:
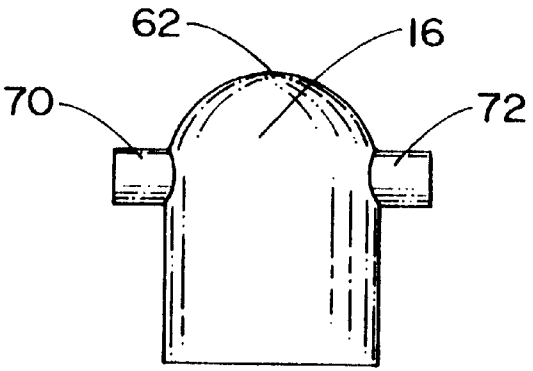
FIG. 6 is a side elevation view of the hose coupling.
Figure 7:
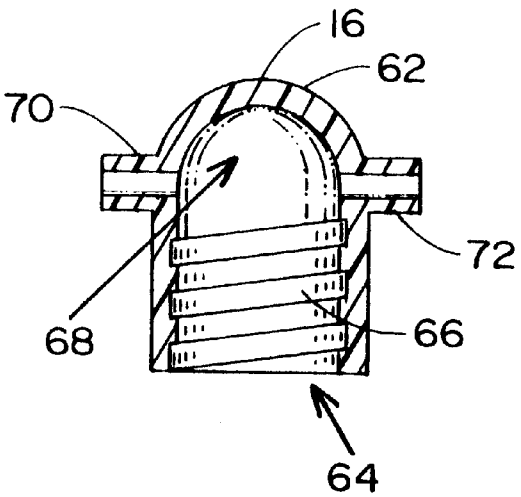
FIG. 7 is a cross-sectional view of the hose coupling take along line 7—7 of FIG. 5.
Figure 5:
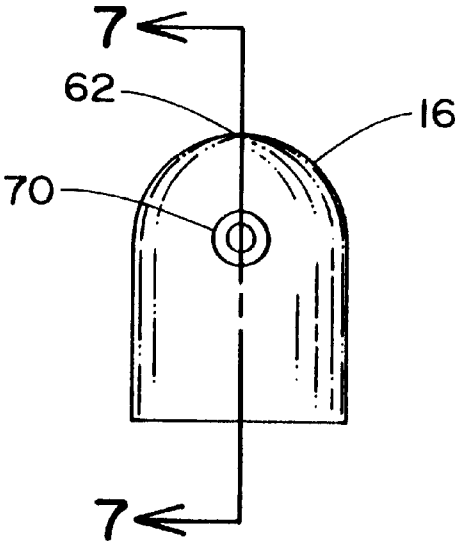
FIG. 5 is a front elevation view of the hose coupling.

Referring to FIG. 3, body 12 includes an inwardly facing surface 56 that is generally convex in shape. Inwardly facing surface 56 includes sets of opposing ribs 58, 60 extending outwardly from openings 32, 34, respectively. Ribs 58, 60 define channels in which nozzles of hose coupling 16 extend, as will be explained in greater detail hereinafter.

Referring to FIGS. 4–7, hose coupling 16 is seen to include a dome shaped, closed end 62, an open end 64, internal threads 66 (see FIG. 7) formed in the interior cavity 68 of coupling 16 and extending upwardly from open end 64, and a pair of nozzles 70, 72 extending outwardly from opposing sides of coupling 16 and in fluid communication with cavity 68 and adjacent closed end 62. Coupling 16 is pivotally connected to body 12 by placing it in recess 26 with nozzles 70, 72 extending through openings 32, 34, respectively, and between ribs 58, 60, respectively. Hose 18 may be connected to coupling 16 via threads 66 and the conventional external threads (not shown) of hose 18. Thus, water passing through hose 18 will exit assembly 10 through nozzles 70, 72.

Figure 8:
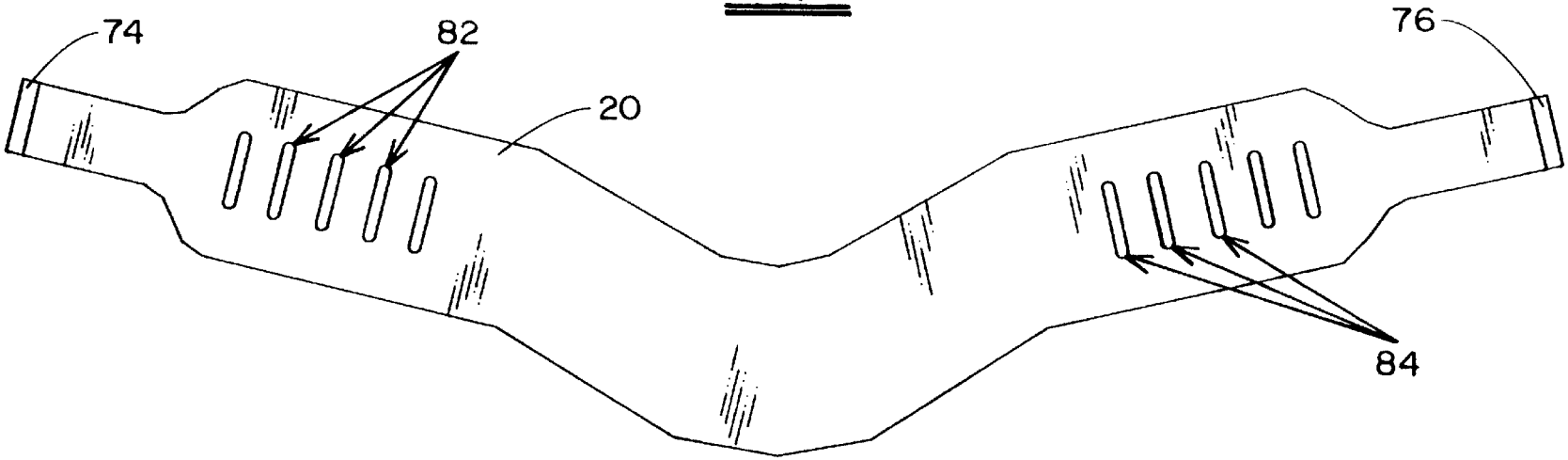
FIG. 8 is a top plan view of the hand strap of the present invention.
Figure 9:
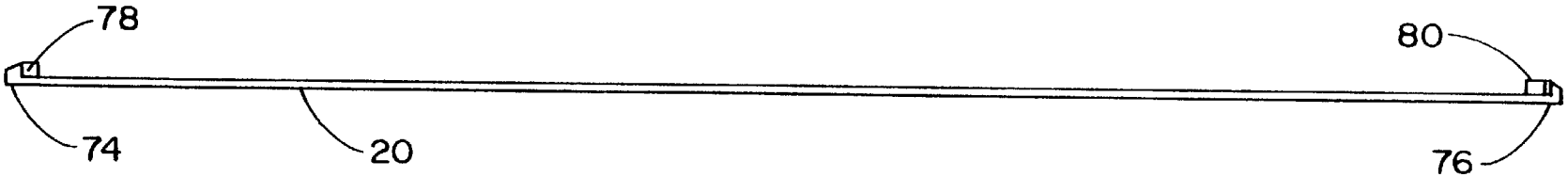
FIG. 9 is a side elevation view of the hand strap.

Referring to FIGS. 8–9, hand strap 20 is seen to include opposing ends 74, 76 having flanges 78, 80 formed thereon, respectively, and a series of slotted openings 82, 84 formed through strap 20, adjacent ends 74, 76, respectively. Ends 74, 76 extend through openings 28, 30, respectively, and flanges 78, 80 are passed through one of openings 82, 84, respectively, (the size of the user's hand would determine which of the openings in series 82, 84 are utilized) thereby securely interconnecting strap 20 to body 12. To make strap 20 as comfortable as possible for a user, it is generally V-shaped, thereby accommodating four fingers thereunder and without restricting the user's thumb from extending outside of it.

Figure 11:
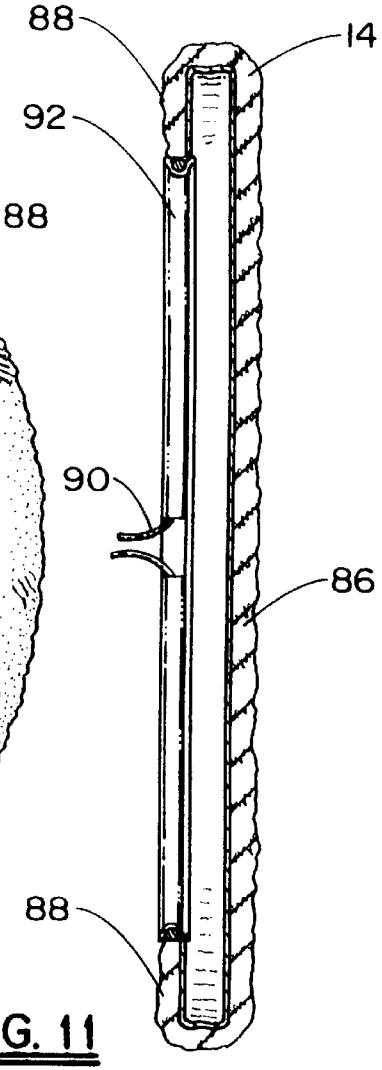
FIG. 11 is a cross sectional view of the washing cloth taken along line 11—11 of FIG. 10.
Figure 10:
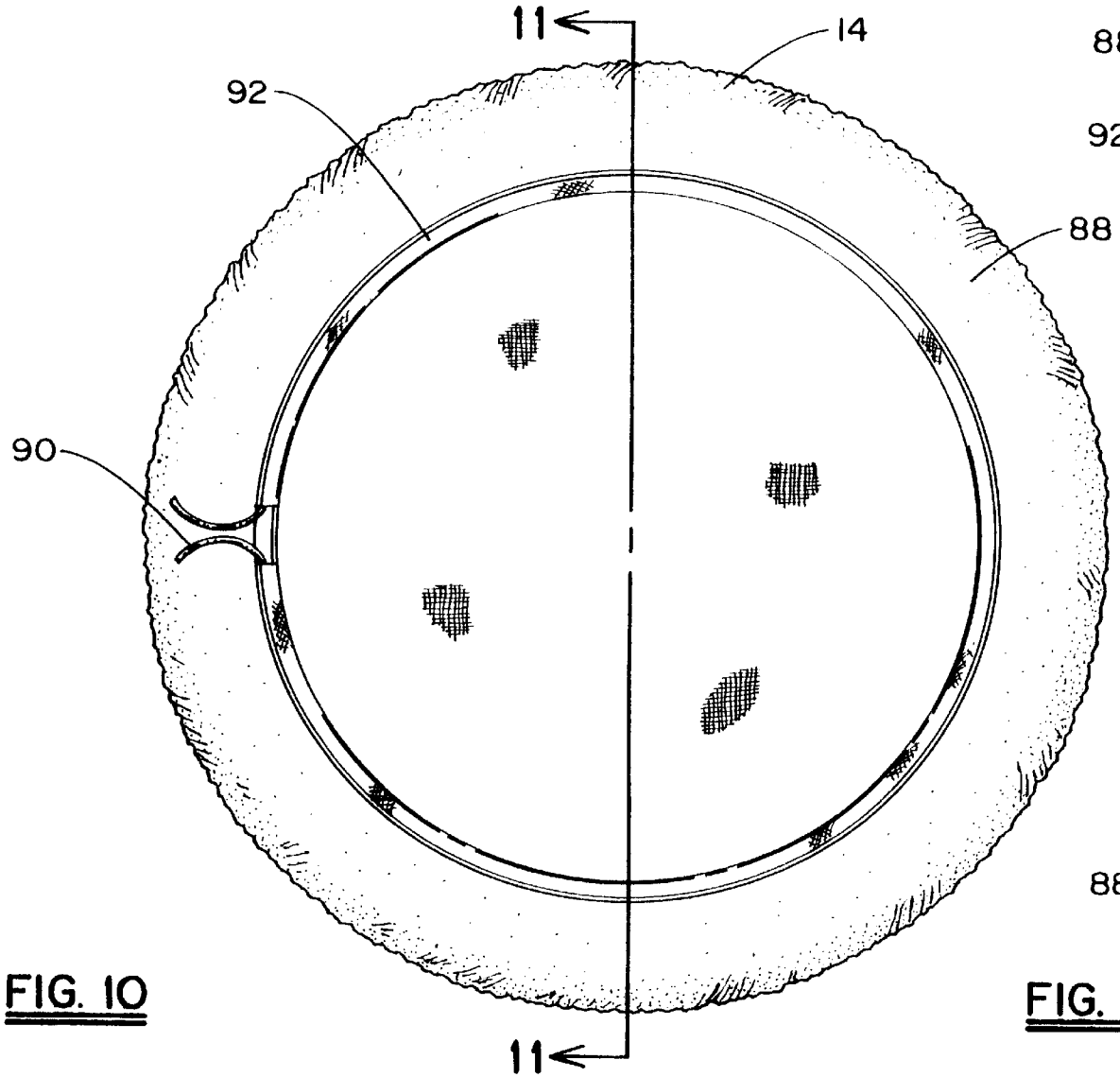
FIG. 10 is a top plan view of the washing cloth.

Referring to FIGS. 10–11, cloth 14 comprises an outwardly facing surface 86, an edge region 88 that folds back upon surface 86, and a drawstring 90 stitched loosely within the edge seam 92 of edge region 88. Cloth 14 is interconnected to body 12 by placing body 12 thereon such that inwardly facing surface 56 is completely covered by surface 86 and edge region 88 extends around and encompasses the edges of regions 36, 38, 40, and 42. Drawstring 90 may then be pulled taut and tied, thereby securely interconnecting cloth 14 to body 12 (of course, any suitable fastener, such as an elastic band, zipper, snaps, buttons, or VELCRO®, could work in place of drawstring 90). Cloth 14 is preferably composed of a soft (non-scratch), water absorbent material, such as sheep's wool or cellulose sponge. It is contemplated that cloth 14 be permanently affixed to body 12, but the removable connection is preferred for purposes of versatility Referring once again to FIGS. 12–14, the entire assembly 10 is shown. In use, soap is dispersed on surface 86 and water is passed through hose 18 and ultimately through nozzles 70, 72. The water is absorbed into cloth 12 and produces a soapy mixture on surface 86. The user may then wash a car, or other item, in the normal fashion. When finished washing, cloth 14 and hose 18 may be removed from body 12. If desired, a chamois or other drying cloth may then be interconnected to body 12 and used to dry the car, or other item.

The foregoing presents the best mode of practicing the present invention, but the scope of the present patent should not be limited thereby, but instead should extend to its full scope and spirit as defined by the appended claims.

What is claimed is:

1. A wash mitt assembly, comprising:

a. a body having an edge and outwardly and inwardly facing surfaces;

b. a recess which extends along a first axis and is formed in said outwardly facing surface of said body, wherein said recess includes first and second openings formed through opposing sides thereof;

c. a cloth interconnected to said body in covering relation to said inwardly facing surface; and d. a hose coupling pivotally interconnected to said body, wherein said hose coupling includes first and second nozzles which extend through said first and second openings of said recess, respectively.

2. The wash mitt assembly of claim 1, further comprising a strap having opposing first and second ends and interconnected to said outwardly facing surface of said body.

3. The wash mitt assembly of claim 2, wherein said strap includes a length adjustment mechanism incorporated therein.

4. The wash mitt assembly of claim 3, wherein said length adjustment mechanism comprises first and second pluralities of slotted openings formed through said strap, adjacent said first and second ends, respectively, and first and second flanges formed on said first and second ends, respectively, whereby, said first and second flanges may engage any of said first and second pluralities of slotted openings.

5. The wash mitt assembly of claim 1, wherein said hose coupling comprises an open end and a closed end which define an internal cavity, and at least a first nozzle positioned in fluid communication with said internal cavity.

6. The wash mitt assembly of claim 1, wherein said cloth includes an outwardly facing surface and an edge region that folds back upon said outwardly facing surface.

7. The wash mitt assembly of claim 6, wherein said edge region of said cloth includes an end seam and a drawstring positioned within said end seam.

8. The wash mitt assembly of claim 1, wherein said outwardly facing surface of said body is concave in shape.

9. The wash mitt assembly of claim 1, wherein said cloth is composed of wool.

10. A wash mitt assembly, comprising:

a. a body having an edge and outwardly and inwardly facing surfaces;

b. a recess formed in said outwardly facing surface with first and second openings formed therethrough; and c. a hose coupling seated in said recess and pivotally interconnected to said body, and including first and second nozzles which extend through said first and second openings, respectively.

11. The wash mitt assembly of claim 10, further comprising a hand strap interconnected to said outwardly facing surface of said body.

* * * * *

UNITED STATES PATENT AND TRADEMARK OFFICE

CERTIFICATE OF CORRECTION

PATENT NO. : 6,536,971 B1
DATED : March 25, 2003
INVENTOR(S) : Pieter Schouten

It is certified that error appears in the above-identified patent and that said Letters Patent is hereby corrected as shown below:

Title page,
Item [54], delete "MIT" and substitute -- MITT -- therefor.
Item [57], ABSTRACT,
Line 1, delete "mit" and substitute -- mitt -- therefor.

Signed and Sealed this

Sixth Day of May, 2003

JAMES E. ROGAN
*Director of the United States Patent and Trademark Office*